US009815613B2

(12) United States Patent
Seyfferth De Oliveira

(10) Patent No.: US 9,815,613 B2
(45) Date of Patent: Nov. 14, 2017

(54) CONTAINER WITH ADHESIVE LABEL

(71) Applicant: PHILIP MORRIS PRODUCTS S.A., Neuchatel (CH)

(72) Inventor: Daniel Seyfferth De Oliveira, Curitiba (BR)

(73) Assignee: Philip Morris Products S.A., Neuchatel (CH)

( * ) Notice: Subject to any disclaimer, the term of this patent is extended or adjusted under 35 U.S.C. 154(b) by 318 days.

(21) Appl. No.: 14/369,311

(22) PCT Filed: Dec. 17, 2012

(86) PCT No.: PCT/EP2012/075749
§ 371 (c)(1),
(2) Date: Jun. 27, 2014

(87) PCT Pub. No.: WO2013/098109
PCT Pub. Date: Jul. 4, 2013

(65) Prior Publication Data

US 2014/0374290 A1 Dec. 25, 2014

(30) Foreign Application Priority Data

Dec. 30, 2011 (EP) ..... 11196266

(51) Int. Cl.
*B65D 85/10* (2006.01)
*B65D 5/66* (2006.01)
*B65D 5/60* (2006.01)

(52) U.S. Cl.
CPC ..... *B65D 85/1045* (2013.01); *B65D 5/60* (2013.01); *B65D 5/66* (2013.01); *B65D 5/6602* (2013.01)

(58) Field of Classification Search
CPC ..... B65D 85/1045; B65D 5/60; B65D 5/66; B65D 5/6602

(Continued)

(56) References Cited

U.S. PATENT DOCUMENTS 5,375,704 A 12/1994 Focke
6,736,262 B2 * 5/2004 Focke ..... B65D 85/1081 206/268

(Continued)

FOREIGN PATENT DOCUMENTS

CH 202 391 A 1/1939
CN 1091386 8/1994

(Continued)

OTHER PUBLICATIONS

Extended EP Search Report, Application No. 11196266.8-2308, dated Aug. 16, 2012 (10 pages).

(Continued)

*Primary Examiner* — Luan K Bui
(74) *Attorney, Agent, or Firm* — Mueting, Raasch & Gebhardt, P.A.

(57) ABSTRACT

The present invention relates to a container of consumer goods comprising an outer housing having a box and a lid hinged to the box. An inner package of consumer goods is disposed within the outer housing and has an access opening through which consumer goods can be removed. An adhesive label is provided with a resealable adhesive on a first portion of an inner surface of the adhesive label and an opposed outer surface of the adhesive label is permanently attached to an inner surface of a front wall of the lid of the outer housing. The outer surface of the adhesive label is permanently attached to the inner surface of the front wall of the lid of the outer housing such that the adhesive label is inwardly concave throughout movement of the lid between a closed position and the open position.

20 Claims, 4 Drawing Sheets

(58) Field of Classification Search
USPC ..... 206/256, 265, 268, 273, 460; 229/160.1, 229/87.13, 87.14, 125.34
See application file for complete search history.

(56) References Cited

U.S. PATENT DOCUMENTS

| | | | | |
|---|---|---|---|---|
| 7,455,177 | B2 * | 11/2008 | Serafini | B65D 5/4204 206/265 |
| 7,537,113 | B2 | 5/2009 | Tambo | |
| 8,365,978 | B2 | 2/2013 | Yoshimura | |
| 8,474,612 | B2 | 7/2013 | Bertuzzi | |
| 2005/0130822 | A1 * | 6/2005 | Rath | B65D 75/5827 493/309 |
| 2009/0321437 | A1 * | 12/2009 | Polloni | B65D 5/5035 220/23.9 |
| 2010/0230303 | A1 * | 9/2010 | Buse | B65D 5/38 206/268 |
| 2010/0252462 | A1 * | 10/2010 | Marchetti | B65D 5/606 206/268 |
| 2011/0114518 | A1 * | 5/2011 | Hein | B65B 19/20 206/268 |
| 2011/0233080 | A1 * | 9/2011 | Bertuzzi | B65D 5/543 206/268 |
| 2011/0303567 | A1 | 12/2011 | Bray | |
| 2012/0006823 | A1 * | 1/2012 | Bertuzzi | B65D 75/5838 220/270 |

FOREIGN PATENT DOCUMENTS

| | | |
|---|---|---|
| CN | 102245481 | 11/2011 |
| EP | 0944539 | 3/2003 |
| EP | 2 281 759 | 2/2011 |
| EP | 2 366 637 | 9/2011 |
| EP | 2701994 | 10/2015 |
| GB | 2451180 | 1/2009 |
| JP | 2009-292517 | 12/2009 |
| JP | 2011-251766 | 12/2011 |
| RU | 2330801 | 3/2008 |
| WO | WO 2008/142540 | 11/2008 |
| WO | WO 2013/046444 | 4/2013 |

OTHER PUBLICATIONS

Office Action issued in China for Application No. 201280064579.7, dated Dec. 1, 2015, 14 pages. English translation included.
Office Action issued in Europe for Application No. 12813792.4 dated Mar. 8, 2016 (3 pages).
PCT International Search Report and Written Opinion for International Application No. PCT/EP2012/075739 dated May 27, 2013 (17 pages).
Office Action issued in Japan for Application No. 2014-549415 dated Sep. 20, 2016 (10 pages). English translation included.
Office Action issued in Russia for Application No. 2014131475 dated Dec. 13, 2016 (12 pages). English translation included.
Office Action issued in Japan for Application No. 22014-549415 dated Jun. 27, 2017 (6 pages). English translation included.

* cited by examiner

CONTAINER WITH ADHESIVE LABEL

This application is a U.S. National Stage Application of International Application No. PCT/EP2012/075749, filed Dec. 17, 2012, which was published in English on Jul. 4, 2013, International Patent Publication WO 2013/098109 Al. International Application No. PCT/EP2012075749 claims priority to European Application No. 11196266.8 filed Dec. 30, 2011.

The present invention relates to a container of consumer goods comprising an adhesive label. The container of the present invention finds particular application as a container for elongate consumer goods, such as smoking articles.

Smoking articles such as cigarettes and cigars are commonly packaged in rigid hinge-lid containers having a box and a lid connected to the box about a hinge line extending across a back wall of the container. Such hinge-lid containers are typically constructed from one-piece laminar cardboard blanks. In use, the lid is pivoted about the hinge line to open the container and so gain access to a bundle of smoking articles housed in the box.

The bundle of smoking articles housed in the box is commonly wrapped in an inner liner, or package, of metallised paper, metal foil or other flexible sheet material. To access the bundle of smoking articles within the inner liner, a consumer should remove a pre-perforated upper portion of the inner liner upon first opening of the hinge-lid container.

It is also known to enclose consumer goods, for example a bundle of smoking articles, in a resealable substantially airtight wrapper. The wrapper including the consumer goods may be inserted in a hinge-lid container.

For example, EP-A-0 944 539 discloses a hinge-lid pack of smoking articles in which the smoking articles are provided in a sealed enclosure of a layer of barrier material having an access aperture defined therein. The access aperture is covered by a cover layer with a permanently tacky surface, which can be engaged with the layer of barrier material to reseal the enclosure after the first opening. A frame against which the cover layer may be pressed is provided in the sealed enclosure between the smoking articles and the layer of barrier material.

WO-A-2008/142540 discloses a hinge-lid pack of smoking articles in which the smoking articles are enclosed in an inner package with an extraction opening closed by a cover flap that is fixed to the inner package using non-dry adhesive applied to the underside of the cover flap. In one embodiment, an outer surface of a bottom tab of the cover layer is glued permanently and non-removably to an inner surface of the front wall of the lid so that opening and closing of the lid simultaneously also opens and closes the cover flap. In this embodiment, the cover flap forms an S-shaped fold when opening the lid of the hinge-lid pack.

WO-A-2008/142540 also discloses that the outer surface of a narrow lower end portion of the cover flap of the hinged-lid pack is glued permanently and non-removably to the inner surface of a narrow lower end portion of the front wall of the lid. This allows the cover flap to move during opening and closing of the lid. In particular, the cover flap is inwardly concave relative to the inner package when the lid of the hinge-lid pack is in the closed position. However, as the lid is moved between the closed position and the open position the curvature of the cover flap changes such that when the lid of the hinge-lid pack is in the open position the cover flap is outwardly convex relative to the inner package. The outward bulging cover flap may prevent easy access to the extraction opening and thus hinder the removal of the smoking articles.

EP 2 366 637 discloses a further hinge-lid packet. The hinge-lid packet disclosed in EP 2 366 637 comprises a cup-shaped rigid cardboard outer container and a sealed inner package housed inside the container. The sealed inner package encloses a bundle of cigarettes and has a cigarette extraction opening at its top and front, where the extraction opening is closed by a reclosable sealing panel. The reclosable sealing panel is provided with a flap in the form of a grip tab which enables the user to open the sealing panel simultaneously with the lid, and then close the sealing panel without closing the lid. The lid may then be closed in a separate operation. The outer container has an open top end and a cup-shaped lid joined to the rear wall of the container along a hinge.

It is an object of the present invention to avoid this disadvantage of the prior art pack.

According to the present invention there is provided a container of consumer goods comprising: an outer housing comprising: a box; and a lid hinged to the box along a hinge line extending across a back wall of the outer housing; an inner package enclosing the consumer goods having an access opening; and an adhesive label. A resealable adhesive is provided on a first portion of an inner surface of the adhesive label and an opposed outer surface of the adhesive label is permanently attached to an inner surface of a front wall of the lid of the outer housing at a location at least 30 percent of the height of the front wall from the lower edge of the front wall. The resealable adhesive is provided such that movement of the lid of the outer housing between a closed position and an open position simultaneously moves the adhesive label between a closed position and an open position.

In the closed position the adhesive label covers the access opening of the inner package and is releasably attached to the inner package by the resealable adhesive. In the open position the adhesive label is at least partially detached from the inner package and the access opening of the inner package is at least partially uncovered. The outer surface of the adhesive label is permanently attached to the inner surface of the front wall of the lid of the outer housing such that the adhesive label is inwardly concave throughout movement between the closed position and the open position.

The term "convex" in connection with the adhesive flap is used throughout the specification to indicate that the adhesive label bulges in a direction towards the outside of the lid. The term "concave" in connection with the adhesive label is used throughout the specification to indicate that the adhesive label is bulges in a direction towards the inside of the lid.

Advantageously, by providing a resealable adhesive label that is permanently attached to the inner surface of the lid front wall according to the invention, the adhesive label is biased to stay within the lid during the opening and closing of the lid, such that any obstruction of the opening can be advantageously avoided. Furthermore, the risk of improper folding or wrinkling of the adhesive label, in particular after repeated opening and closing, is significantly reduced or eliminated, as the label is biased towards a simple C-shape instead of a more complicated S-shape. Furthermore, the risk of the label being damaged is reduced since it is not loose, but substantially contained within and protected by the lid of the container during use.

The term "C-shaped" is used herein to refer to a shape that has the form of a curve without an inflexion point. The term "S-shaped" is used herein to refer to a shape that has the form of a curve with one inflexion point. The term "U-shaped" is used herein to refer to a shape that comprises three parts, wherein the first part and the third part are parallel to each other and extend in the same direction perpendicular to the second part.

The adhesive label provided for sealing the cover layer over the access opening comprises a resealable adhesive, such that the label can be removed from a surface of the inner package and reattached to the same surface a number of times. This allows for repeated opening and closing of the inner package in order to access the consumer goods individually. The resealable adhesive will preferably provide sufficient adhesion for the label to be reattached at least as many times as there are consumer goods in the inner package so that it can be used to reseal the inner package until the container is empty. Advantageously, this may allow the consumer goods to be protected in the container more effectively.

Suitable resealable adhesives are known to the skilled person and a wide variety of adhesives are commercially available from a number of suppliers. The selection of a suitable adhesive may depend upon the material forming the wrapper or package to which the adhesive label is sealed or resealed during use.

Preferably, the curvature of the adhesive label relative to the lid of the outer housing is substantially constant throughout movement between the closed position and the open position. Advantageously, having such a substantially constant curvature may reduce the risk of the label becoming damaged due to fatigue or the like.

In contrast to the cover flap of the hinge-lid packs disclosed in WO-A-2008/142540, the outer surface of the adhesive label of containers according to the present invention is permanently attached to the inner surface of the front wall of the lid of the outer housing such that the adhesive label is inwardly concave throughout movement between the closed position and the open position. This advantageously reduces the risk of the cover flap becoming stuck due to the resealable adhesive provided on the first portion of the inner surface of the adhesive label coming into contact with the lid.

Preferably, the outer surface of the adhesive label is permanently attached to the front wall of the lid of the outer housing at a location at least 50 percent of the height of the front wall. Yet more preferably, the outer surface of the adhesive label is permanently attached to the front wall of the lid of the outer housing at a location at least 80 percent of the height of the front wall. By permanently attaching the outer surface of the adhesive label in such a way the label remains inwardly concave throughout movement between the closed position and the open position. The height of the lid front wall is measured from the lower edge of the lid in the vertical direction when the container is in the vertical position.

Preferably, a lower end portion of the outer surface of the adhesive label is permanently attached to a lower end portion of the inner surface of the front wall of the lid. Alternatively, a portion of the outer surface of the adhesive label defined by a free edge of the adhesive label and a line at least 30 percent of the height of the front wall, preferably 50 percent of the height of the front wall, more preferably 80 percent of the height of the front wall from the free edge may be permanently attached to the inner surface of the front wall of the lid. This allows a secure attachment of the adhesive label to the inner surface of the front wall of the lid.

Preferably, the ratio of the height of the hinge line of the outer housing to the height of the inner package is between about 0.95 and about 1.00. More preferably, the height of the hinge line of the outer housing is substantially equal to or greater than the height of the inner package. This way, the adhesive label is peeled from the inner package as the lid is moved from the closed to the open position. Providing the hinge line in such a position, may also ensure that, as the lid is moved from the open position to the closed position, the adhesive label initially contacts the inner package substantially in the location that the adhesive label will be in when the lid is in the closed position. Thus a secure seal between the adhesive label and the inner package may be effected.

When the container has dimensions similar to those of a conventional smoking article container, the hinge line is located preferably less than or equal to 12 mm from the top of the container, more preferably less than or equal to 8 mm from the top of the container, and yet more preferably less than or equal to 6 mm from the top of the container.

Preferably, a second portion of the inner surface of the adhesive label located at the lower end of the adhesive label is substantially free of adhesive. The second portion is defined by a free edge of the adhesive label and a line, parallel to the free edge. The line is preferably located at least 4 percent of the height of the front wall from the free edge, more preferably at least 8 percent of the height of the front wall from the free edge, yet more preferably at least 12 percent of the height of the front wall from the free edge. That is, in a conventional container comprising smoking articles, the line is located at least 1 mm from the free edge, preferably at least 2 mm, more preferably at least 3 mm. The second portion is provided to reduce the force required to move the lid from the closed position to an open position. The second portion may be neutralised to ensure that it does not adhere to the inner package.

Preferably, the inner package comprises one or more lines of weakness defining an access portion and wherein a third portion of the inner surface of the adhesive label is permanently attached to the access portion of the inner package such that first opening of the lid of the outer housing at least partially separates the access portion of the inner package from the remainder of the inner package along the one or more lines of weakness to create the access opening in the inner package. More preferably, the access portion of the inner package is partially separated from the remainder of the inner package along the one or more lines of weakness on first opening of the lid of the outer housing such that the access portion of the inner package remains attached to the remainder of the inner package during subsequent opening and closing of the lid of the outer housing. The resealable adhesive provided on the first portion of the inner surface of the adhesive label may extend about substantially the entire periphery of the access portion of the inner package.

Preferably, in the closed position the resealable adhesive provided on the first portion of the inner surface of the adhesive label extends about substantially the entire periphery of the access opening of the inner package.

By providing the inner package with a defined access portion the inner package may be more securely sealed before the first opening of the container. This may increase the storage life of the consumer goods contained within the container.

In preferred embodiments of the invention, the container further comprises an inner frame 114 (e.g., as shown in FIGS. 1 and 3) within the inner package. Preferably, the inner frame 114 is a U-shaped inner frame 114 having a front wall and a pair of opposed side walls. Alternatively, the inner frame 114 may be provided between the container and the inner package. Advantageously, an inner frame 114 with a large surface area increases the structural strength of the container. The increased structural strength provided by the inner frame 114 allows a secure closing of the adhesive label. This is particularly advantageous for subsequent closing operations when the container is no longer full.

Where the inner frame 114 is provided between the container and the inner package, the inner frame 114 may comprise a cover layer wherein the surface structure of the cover layer is selected such that substantially no adhesive is transferred from the adhesive label to the cover layer when the adhesive label is attached to the cover layer of the inner frame 114. For example, the inner frame 114 may comprise a cover layer of laminated polyethylene terephthalate (PET). The cover layer may be transparent or metallised. Preventing the transfer of adhesive from the label to the inner frame 114 has the advantage that dust or small particles, for example so called "tobacco shorts", will not attach to the inner frame 114.

Preferably, the inner package is formed of metal foil or metallised paper. The inner package material may be formed as a laminate of a metallised polyethylene film, and a liner material. The liner material may be a supercalendered glassine paper. In addition, the inner package material may be provided with a print-receptive top coating.

Preferably, the consumer goods are smoking articles. However, the container may be suitable for a variety of consumer goods, such as confectionary, dry foodstuff or the like.

As used herein, the terms 'front', 'back, 'upper', 'lower', 'top', 'bottom' and 'side', refer to the relative positions of portions of containers according to the invention and components thereof when the container is in an upright position with the lid of the outer housing in the closed position and the hinge line at the back of the container. When describing containers according to the present invention, these terms are used irrespective of the orientation of the container being described.

The term "longitudinal" refers to a direction from bottom to top or vice versa. The term "transverse" refers to a direction perpendicular to the longitudinal direction.

The container is preferably a rectangular parallelepiped comprising two wider walls spaced apart by two narrower walls.

The term "hinge line" refers to a line about which the lid may be pivoted in order to open the container. A hinge line may be, for example, a fold line or a score line in the panel forming the back wall of the container.

The container may be formed from any suitable materials including, but not limited to, cardboard, paperboard, plastic, metal, or combinations thereof. Preferably, the outer housing are each formed from one or more folded laminar cardboard blanks and preferably, the cardboard has a weight of between about 100 grams per square meter and about 350 grams per square meter.

Where the container comprises an outer wrapper, preferably, the outer wrapper is a transparent polymeric film of, for example, high or low density polyethylene, polypropylene, oriented polypropylene, polyvinylidene chloride, cellulose film, or combinations thereof and the outer wrapper is applied in a conventional manner. The outer wrapper may include a tear tape. In addition, the outer wrapper may be printed with images, consumer information or other data.

As described above, containers according to the invention may be in the shape of a rectangular parallelepiped, with right-angled longitudinal and right-angled transverse edges. Alternatively, the container may comprise one or more rounded longitudinal edges, rounded transverse edges, bevelled longitudinal edges or bevelled transverse edges, or combinations thereof. For example, the container according to the invention may comprise, without limitation:

- One or two longitudinal rounded or bevelled edges on the front wall, and/or one or two longitudinal rounded or bevelled edges on the back wall.
- One or two transverse rounded or bevelled edges on the front wall, and/or one or two transverse rounded or bevelled edges on the back wall.
- One longitudinal rounded edge and one longitudinal bevelled edge on the front wall, and/or one transverse rounded edge and one transverse bevelled edge on the back wall.
- One or two transverse rounded or bevelled edges on the front wall and one or two longitudinal rounded or bevelled edges on the front wall.
- Two longitudinal rounded or bevelled edges on a first side wall or two transverse rounded or bevelled edges on the second side wall.

Where the container comprises one or more bevelled edge, preferably the bevelled edge has a width of between about 1 mm and about 10 mm, preferably between about 2 and about 6 mm. Alternatively, the container may comprise a double bevel formed by three parallel creasing or scoring lines that are spaced such that two distinct bevels are formed on the edge of the container.

Alternatively, the container may have a non-rectangular transversal cross section, for example polygonal such as triangular or hexagonal, semi-oval or semi-circular.

Containers according to the invention find particular application as packs for elongate smoking articles such as, for example, cigarettes, cigars or cigarillos. It will be appreciated that through appropriate choices of the dimensions thereof, containers according to the invention may be designed for different numbers of conventional size, king size, super-king size, slim or super-slim cigarettes. Alternatively, other consumer goods may be housed inside the container.

Through an appropriate choice of the dimensions thereof, containers according to the invention may be designed to hold different total numbers of smoking articles, or different arrangements of smoking articles. For example, through an appropriate choice of the dimensions thereof, containers according to the invention may be designed to hold a total of between ten and thirty smoking articles.

The smoking articles may be arranged in different collations, depending on the total number of smoking articles. For example, the smoking articles may be arranged in a single row of six, seven, eight, nine or ten. Alternatively, the smoking articles may be arranged in two or more rows. The two or more rows may contain the same number of smoking articles. For example, the smoking articles may be arranged in: two rows of five, six, seven, eight, nine or ten; three rows of five or seven; or four rows of four, five or six. Alternatively, the two or more rows may include at least two rows containing different number of smoking articles to each other. For example, the smoking articles may be arranged in: a row of five and a row of six (5-6); a row of six and a row of seven (6-7); a row of seven and a row of eight (7-8); a middle row of five and two outer rows of six (6-5-6); a middle row of five and two outer rows of seven (7-5-7); a middle row of six and two outer rows of five (5-6-5); a middle row of six and two outer rows of seven (7-6-7); a middle row of seven and two outer rows of six (6-7-6); a middle row of nine and two outer rows of eight (8-9-8); or a middle row of six with one outer row of five and one outer row of seven (5-6-7).

Containers according to the present invention may hold smoking articles of the same type or brand, or of different types or brands. In addition, both filterless smoking articles and smoking articles with various filter tips may be contained, as well as smoking articles of differing length (for example, between about 40 mm and about 180 mm), diameter (for example, between about 4 mm and about 9 mm). In addition, the smoking articles may differ in strength of taste, resistance to draw and total particulate matter delivery. Preferably, the dimensions of the container are adapted to the length of the smoking articles, and the collation of the smoking articles. Typically, the outer dimensions of the container are between about 0.5 mm to about 5 mm larger than the dimensions of the bundle or bundles of smoking articles housed inside the container.

The length, width and depth of containers according to the invention may be such that, in the closed lid position, the resultant overall dimensions of the container are similar to the dimensions of a typical disposable hinge-lid pack of twenty cigarettes.

Preferably, containers according to the invention have a height of between about 60 mm and about 150 mm, more preferably a height of between about 70 mm and about 125 mm, wherein the height is measured from the bottom wall to the top wall of the container.

Preferably, containers according to the invention have a width of between about 12 mm and about 150 mm, more preferably a width of between about 70 mm and about 125 mm, wherein the width is measured from one side wall to the other side wall of the container.

Preferably, containers according to the invention have a depth of between about 6 mm and about 150 mm, more preferably a depth of between about 12 mm and about 25 mm wherein the depth is measured from the front wall to the back wall of the container (comprising the hinge between box and lid).

Preferably, the ratio of the height of the container to the depth of the container is in between about 0.3 to 1 and about 10 to 1, more preferably between about 2 to 1 and about 8 to 1, most preferably between about 3 to 1 and 5 to 1

Preferably, the ratio of the width of the container to the depth of the container is in between about 0.3 to 1 and about 10 to 1, more preferably between about 2 to 1 and about 8 to 1, most preferably between about 2 to 1 and 3 to 1.

Preferably, the ratio of the height of the lid back wall to the height of the box back wall of the outer sleeve is between about 0 to 1 (lid located at the top edge of the container) to about 1 to 1, more preferably, between about 1 to 5 and about 1 to 10, most preferably, between about 1 to 6 to about 1 to 8.

Preferably, the ratio of the height of the lid front wall of the outer sleeve to the height of the box front wall of the outer sleeve is between about 1 to 0 (lid covering the entire front wall) to about 1 to 10, more preferably, between about 1 to 1 and about 1 to 5, most preferably, between about 1 to 2 and about 1 to 3.

Where the container comprises smoking articles, the container may further comprise waste-compartments (for example for ash or butts) or other consumer goods, for example matches, lighters, extinguishing means, breath-fresheners or electronics. The other consumer goods may be attached to the outside of the container, contained within the container along with the smoking articles, in a separate compartment of the container or combinations thereof.

The exterior surfaces of containers according to the invention may be printed, embossed, debossed or otherwise embellished with manufacturer or brand logos, trade marks, slogans and other consumer information and indicia.

Once filled, containers according to the invention may be shrink wrapped or otherwise over wrapped with a transparent polymeric film of, for example, high or low density polyethylene, polypropylene, oriented polypropylene, polyvinylidene chloride, cellulose film, or combinations thereof in a conventional manner. Where containers according to the invention are over wrapped, the over wrapper may include one or more a tear tapes. In addition, the over wrapper may be printed with images, consumer information or other data.

It should also be appreciated that particular combinations of the various features described and defined in any aspects of the invention can be implemented and/or supplied and/or used independently.

The invention will be further described, by way of example only, with reference to the accompanying drawings in which.

Figure 1:
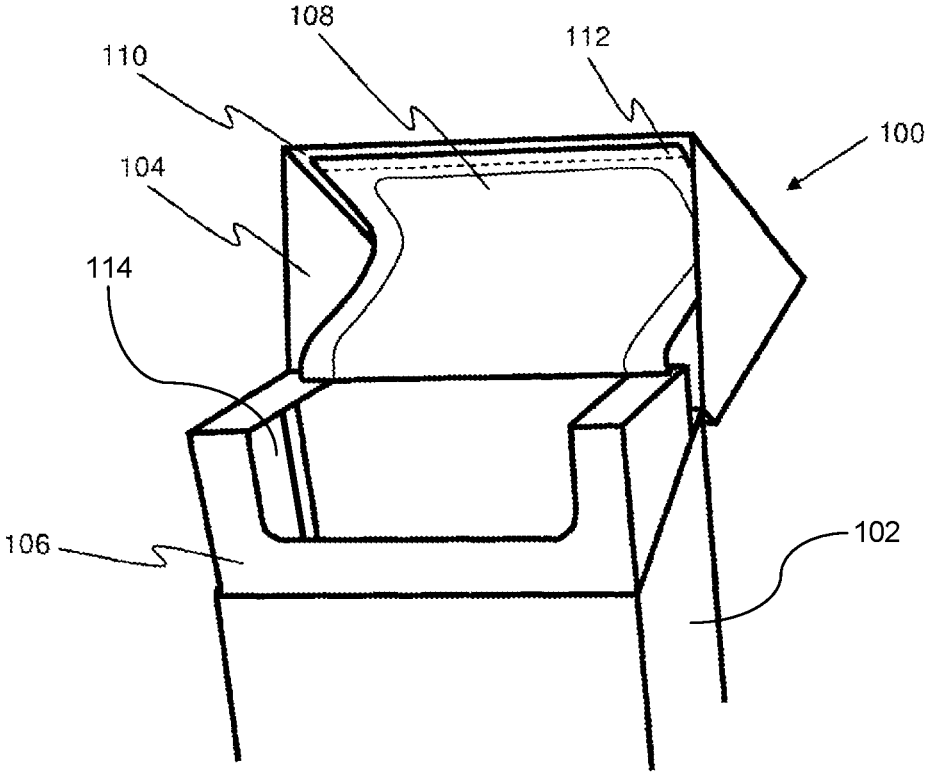
FIG. 1 shows a representation of a container according to the present invention.

FIG. 1 shows a container 100 comprising a box 102 (the bottom section of the box is not shown) and a lid 104. An inner package 106 is contained within the box. The consumer goods, such as smoking articles, are contained within the inner package 106. The inner package 106 may be permanently attached to the inner surfaces of the box to retain the inner package in the box during use of the container.

The adhesive label 108 is positioned such that a lower portion of the outer surface is permanently attached to the inner surface 110 of the lid 104. The remainder of the outer surface of the adhesive label is not attached to any portion of the container. An upper portion of the inner surface of the adhesive label is attached to the inner package at the top of the back wall of the inner package and at a back portion of the top wall of the inner package. Resealable adhesive is positioned around the periphery of the inner surface of the adhesive label such that the adhesive label can be sealed and unsealed to the inner package.

The access opening of the inner package is provided with an access portion that, before the first opening of the container, is attached to the periphery of the access opening at lines of weakness. A portion of the inner surface of the adhesive label is provided with permanent adhesive to permanently attach the adhesive label to the access portion of the inner package. Therefore, on first opening the label acts to separate the access portion from the inner package at the lines of weakness providing access to the inside of the inner package through the access opening. As described above, the inner package is subsequently sealed by the label when the lid is in the closed position.

To enable the consumer to open the lid more easily, an adhesively neutralised portion 112 is provided on a lower portion of the inner surface of the adhesive label. As used herein, the term adhesively neutralised refers to adhesive that has been neutralised to remove the adhesiveness of the adhesive. Alternatively, the term adhesively neutralised refers to a portion of the adhesive label within which no adhesive has been applied. By providing an adhesively neutralised portion, the force required to initially open the lid is reduced since the area of resealable adhesive on the adhesive label is reduced.

Figure 2:
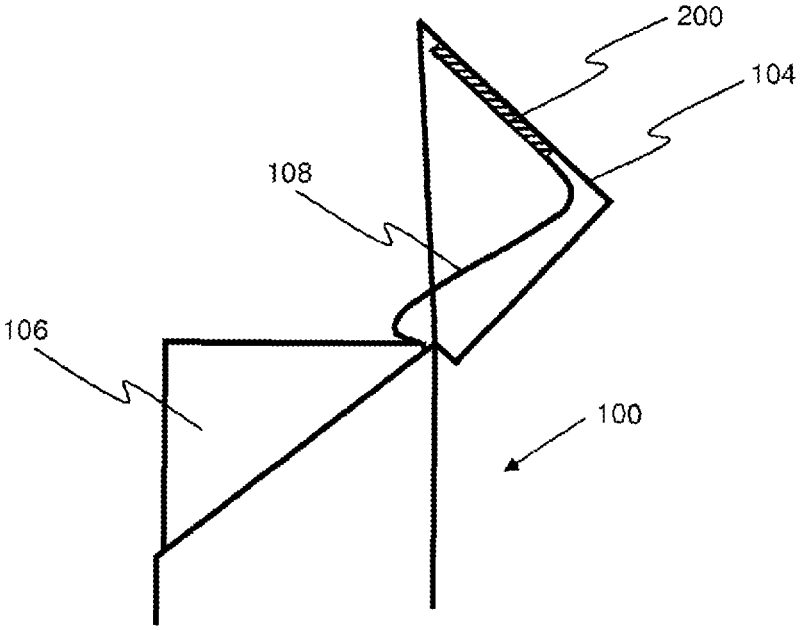
FIG. 2 shows a side view of a container according to the present invention with the lid in an open position.
Figure 3:
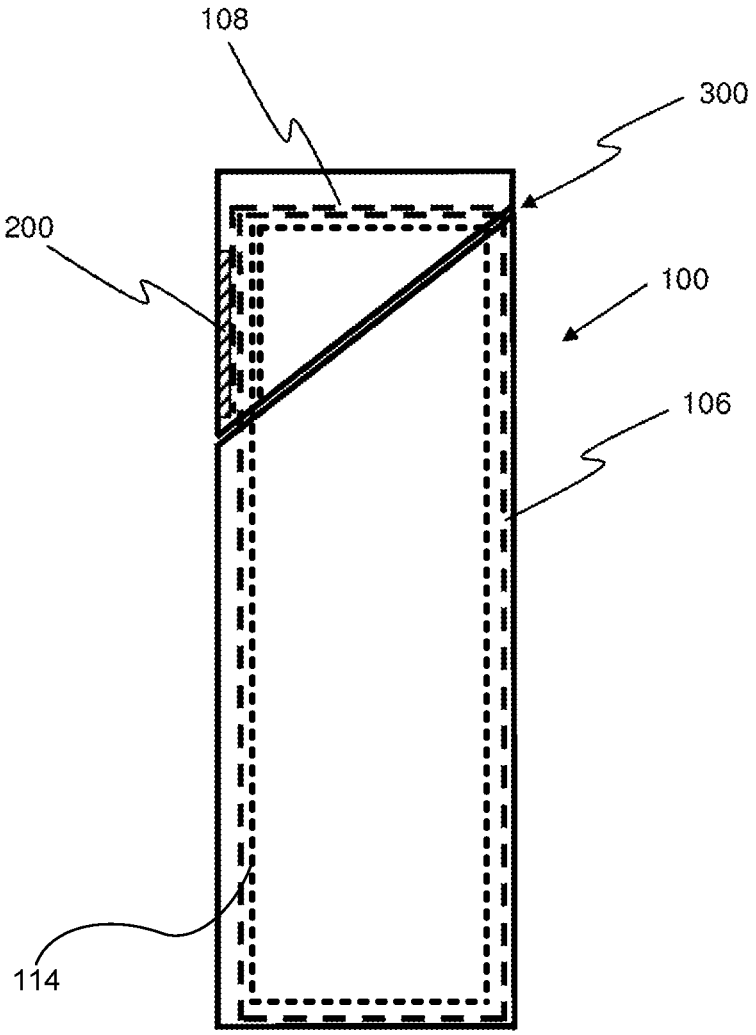
FIG. 3 shows a side view of a container according to the present invention with the lid in the closed position.

FIG. 2 shows a side view of container 100 shown in FIG. 1. As can be seen the adhesive label 108 is permanently attached to the inner surface of the front wall of the lid 104 by the permanent adhesive 200. The dimensions of the permanent adhesive portion 200 are such that the adhesive label 108 remains inwardly concave throughout movement of the lid from the closed position to the open position. As can be seen, the adhesive portion 200 extends at least 50 percent of the height of the front wall from the lower edge of the lid. As shown in FIG. 3 when the lid is in the closed position the adhesive label is placed in contact with the inner package 106 and the resealable adhesive attaches the adhesive label to the inner package. The label contacts the inner package on both the top wall of the inner package and on a portion of the front wall of the inner package. The access opening of the inner package is covered by the label and in this way a sealed inner package is formed. The seal acts to protect the consumer goods, such as smoking articles, contained within the inner package.

In addition to the neutralised area 112, to ensure that the lid can be opened easily by the user the hinge line 300 is located at a height that is equal to the position of the top of the inner package. Locating the hinge line at this height, or above this height, ensures that there is no sliding movement between the lid and the inner package. Therefore, the adhesive label is peeled from the inner package which requires less force than sliding the label from the inner package.

Figure 4:
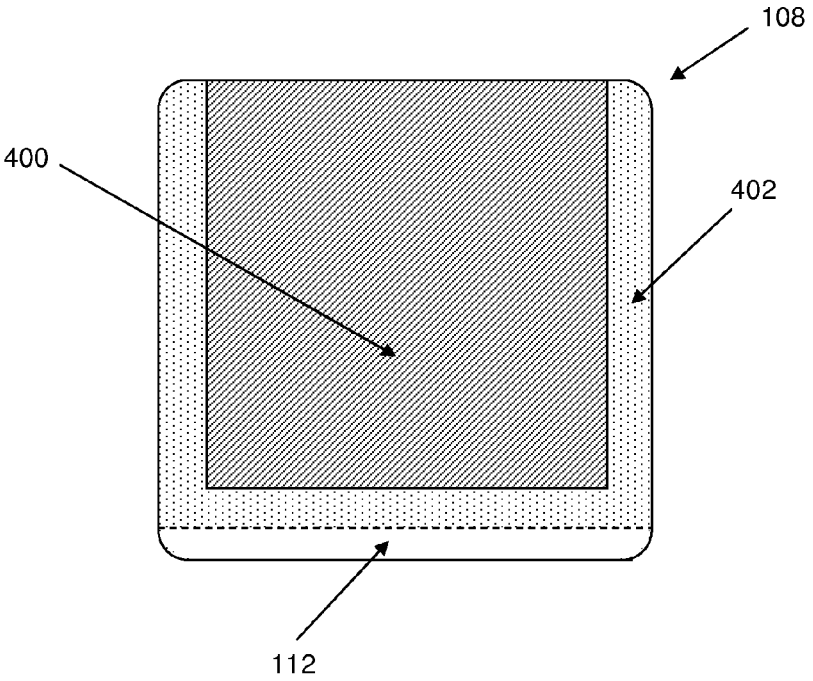
FIG. 4 shows the inner side of an adhesive label according to the present invention.

FIG. 4 shows the inner surface of the adhesive label 108. The inner surface has a portion 400 of permanent adhesive. As described above, the portion 400 of permanent adhesive is adapted to permanently attach the label to the access portion of the inner package. A portion 402 is provided with resealable adhesive and is positioned around the periphery of the permanent adhesive portion 400. As described above the resealable adhesive portion 402 is adapted to removably adhere to the inner package 106. The lower edge of the adhesive label 108 is provided with an adhesively neutralised portion 112 to enable the user to more easily open the container.

Figure 5:
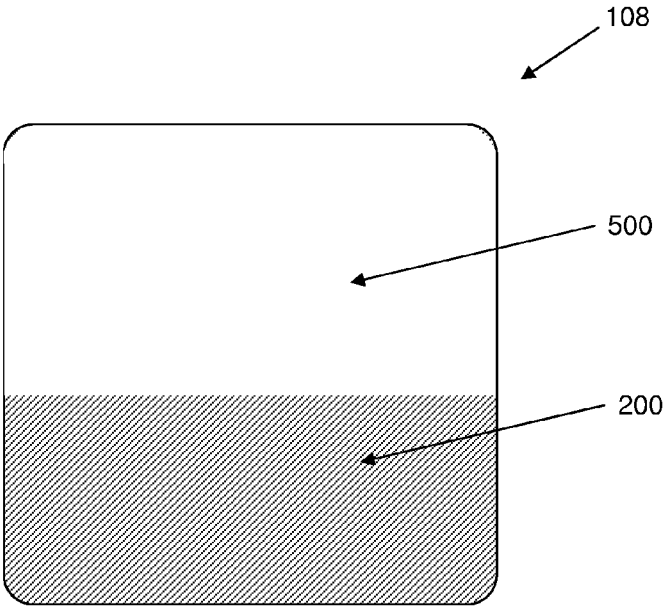
FIG. 5 shows the outer side of an adhesive label according to the present invention.

FIG. 5 shows the outer surface of the adhesive label 108. The outer surface has a portion 200 of permanent adhesive. As described above, the portion 200 of permanent adhesive is adapted to permanently attach to the inner surface of the front wall of the lid. The dimensions of the portion 200 are such that the adhesive label remains attached to the lid in such a way that the label remains inwardly concave throughout movement of the lid from the closed position to the open position. A portion 500 of the outer surface of the adhesive label does not have adhesive.

Figure 6:
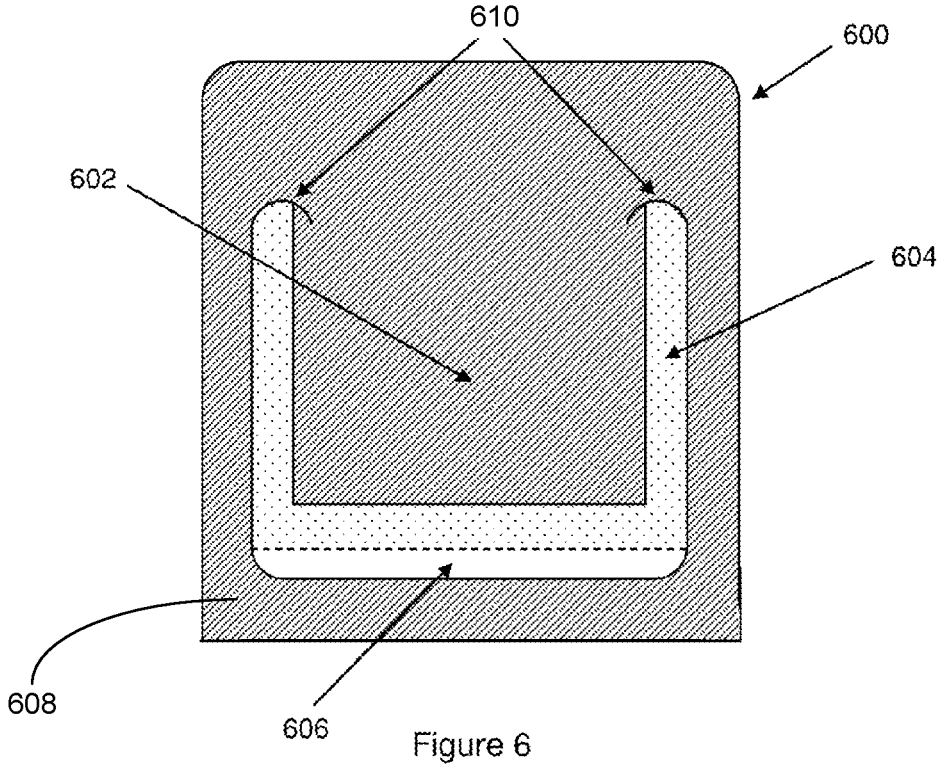
FIG. 6 shows the inner side of an alternative embodiment of an adhesive label according to the present invention.

FIG. 6 shows an alternative example 600 of the inner surface of an adhesive label. The adhesive label 600 is similar to that shown in FIGS. 4 and 5, and comprises a portion 602 of permanent adhesive adapted to permanently attach the label to the access portion of the inner package. Furthermore, label 600 also comprises a portion 604 of resealable adhesive adapted to seal and reseal the label to the inner package, and a neutralised portion 606 to enable the consumer to more easily open the container. In addition to these features, label 600 comprises a portion 608 surrounding the portion of resealable adhesive 604. The portion 608 is provided with permanent adhesive, and in use is permanently attached to the inner package. The additional portion 608 provides additional rigidity to the inner package, and may enable a more secure seal to be provided between the label and the inner package. The width of label 600 is substantially equal to the width of the front wall of the inner package, and this may enable the label to be positioned more easily and accurately during manufacture. The semi-circular cuts 610 are provided to reduce the risk that the portion of the label 600 attached to the lid does not tear with respect to the portion of the label 600 that is attached to the inner package during opening of the lid.

Figure 7:
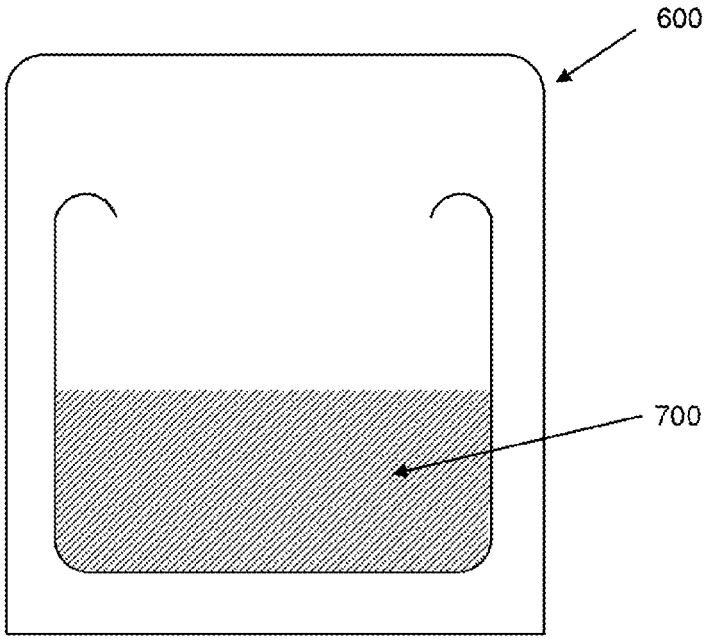
FIG. 7 shows the outer side of an alternative embodiment of an adhesive label according to the present invention.

FIG. 7 shows the outer surface of the label 600. The portion 700 is provided with permanent adhesive to permanently attach a portion of the label 600 to the lid of the container. As described above, the dimensions of the portion 700 are such that the label remains inwardly concave during movement of the lid from the closed to the open position. The remainder of the outer surface does not have adhesive, and is not attached to the container.

In all figures, the dashed lines represent "fold" lines, and the solid lines represent "cut" lines.

The invention claimed is:

1. A container of consumer goods comprising:

an outer housing comprising:

a box; and a lid hinged to the box along a hinge line extending across a back wall of the outer housing, the lid comprising a front wall;

an inner package enclosing the consumer goods having an access opening; and an adhesive label, wherein a resealable adhesive is provided on a first portion of an inner surface of the adhesive label and an opposed outer surface of the adhesive label is permanently attached to an inner surface of the front wall of the lid of the outer housing such that movement of the lid of the outer housing moves the adhesive label between a closed position and an open position simultaneously with the lid, and wherein the outer surface of the adhesive label is permanently attached to the inner surface of the front wall of the lid of the outer housing by an adhesive portion extending at least 50 percent of a total height of the front wall from a lower edge of the front wall, such that the adhesive label is inwardly concave throughout its movement.

2. A container according to claim 1 wherein the curvature of the adhesive label relative to the lid of the outer housing is substantially constant throughout movement between the closed position and the open position.

3. A container according to claim 1 wherein a lower end portion of the outer surface of the adhesive label is permanently attached to a lower end portion of the inner surface of the front wall of the lid.

4. A container according to claim 1 wherein the ratio of the height of the hinge line of the outer housing to the height of the inner package is between about 0.95 and about 1.00.

5. A container according to claim 4 wherein the height of the hinge line of the outer housing is substantially equal to or greater than the height of the inner package.

6. A container according to claim 1 wherein a second portion of the inner surface of the adhesive label located at the lower end of the adhesive label is substantially free of adhesive.

7. A container according to claim 1 wherein the inner package comprises one or more lines of weakness defining an access portion and wherein an additional portion of the inner surface of the adhesive label is attached to the access portion of the inner package such that first opening of the lid of the outer housing at least partially separates the access portion of the inner package from the remainder of the inner package along the one or more lines of weakness to create the access opening in the inner package.

8. A container according to claim 7 wherein the access portion of the inner package is partially separated from the remainder of the inner package along the one or more lines of weakness on first opening of the lid of the outer housing such that the access portion of the inner package remains attached to the remainder of the inner package during subsequent opening and closing of the lid of the outer housing.

9. A container according to claim 7 wherein the resealable adhesive provided on the first portion of the inner surface of the adhesive label extends about substantially the entire periphery of the access portion of the inner package.

10. A container according to claim 1 wherein in the closed position the resealable adhesive provided on the first portion of the inner surface of the adhesive label extends about substantially the entire periphery of the access opening of the inner package.

11. A container according to claim 1 further comprising an inner frame within the inner package.

12. A container according to claim 11 wherein the inner frame is a U-shaped inner frame having a front wall and a pair of opposed side walls.

13. A container according to claim 1 wherein the consumer goods are smoking articles.

14. A container according to claim 2 wherein the outer surface of the adhesive label is permanently attached to the front wall of the lid of the outer housing by an adhesive portion extending at least 80 percent of the total height of the lid front wall.

15. A container according to claim 8 wherein the resealable adhesive provided on the first portion of the inner surface of the adhesive label extends about substantially the entire periphery of the access portion of the inner package.

16. A container according to claim 2 wherein a lower end portion of the outer surface of the adhesive label is permanently attached to a lower end portion of the inner surface of the front wall of the lid.

17. A container according to claim 1 wherein a lower end portion of the outer surface of the adhesive label is permanently attached to a lower end portion of the inner surface of the front wall of the lid.

18. A container according to claim 7 further comprising an inner frame within the inner package.

19. A container according to claim 18 wherein the inner frame is a U-shaped inner frame having a front wall and a pair of opposed side walls.

20. A container of consumer goods comprising:

an outer housing comprising:

a box; and a lid hinged to the box along a hinge line extending across a back wall of the outer housing, the lid comprising a front wall having a lower edge and an upper edge and a total height extending from the lower edge to the upper edge;

an inner package enclosing the consumer goods having an access opening; and an adhesive label, wherein a resealable adhesive is provided on a first portion of an inner surface of the adhesive label and an opposed outer surface of the adhesive label is permanently attached to an inner surface of the front wall of the lid such that movement of the lid of the outer housing moves the adhesive label between a closed position and an open position simultaneously with the lid, and wherein the outer surface of the adhesive label is permanently attached to the inner surface of the front wall of the lid by an adhesive extending from a first height to a second height, the first height being at 30 percent of the total height from the lower edge, and the second height being at 80 percent of the total height from the lower edge, such that the adhesive label is inwardly concave in the closed position and the open position.

* * * * *